US007478493B2

(12) United States Patent
Brown

(10) Patent No.: US 7,478,493 B2
(45) Date of Patent: Jan. 20, 2009

(54) DISPLAY STRUCTURE

(75) Inventor: Ian Brown, Wynberg Cape Town (ZA)

(73) Assignee: Bowhead International (Pty) Ltd, Pinelands (ZA)

( * ) Notice: Subject to any disclaimer, the term of this patent is extended or adjusted under 35 U.S.C. 154(b) by 190 days.

(21) Appl. No.: 11/364,574

(22) Filed: Feb. 28, 2006

(65) Prior Publication Data

US 2006/0207143 A1 Sep. 21, 2006

Related U.S. Application Data

(63) Continuation of application No. PCT/ZA2004/000102, filed on Aug. 26, 2004.

(30) Foreign Application Priority Data

Aug. 28, 2003 (ZA) ..... 2003/6707

(51) Int. Cl.
*G09F 15/00* (2006.01)

(52) U.S. Cl. ..... 40/610; 248/165

(58) Field of Classification Search ..... 40/610, 40/607.04; 248/159, 165
See application file for complete search history.

(56) References Cited

U.S. PATENT DOCUMENTS 2,379,577 A * 7/1945 Harsted ..... 52/110
3,669,133 A * 6/1972 Hyman ..... 135/74
3,730,544 A * 5/1973 Hyman ..... 280/819
3,886,700 A * 6/1975 Lambert ..... 52/108
5,179,907 A 1/1993 Galbraith et al.
5,441,267 A 8/1995 Alder
6,038,802 A * 3/2000 Tidwell ..... 40/610
6,289,839 B1 9/2001 Flores
6,332,284 B1 * 12/2001 Tafforeau ..... 40/603
6,557,572 B2 * 5/2003 Lah ..... 135/114
6,584,928 B2 * 7/2003 Kinahan ..... 116/174

* cited by examiner

*Primary Examiner*—Cassandra Davis
(74) *Attorney, Agent, or Firm*—Dalina Law Group, P.C.

(57) ABSTRACT

A support (12) for a display device (10) is disclosed, the support (12) comprising a pole (14) which consists of a lower pole section (24/26), an intermediate pole section (20, 22) and an upper pole section (16). The three pole sections (16, 20/22 and 24/26) fitting together in spigot and socket fashion. An upper component (28) is provided in the upper end of the upper pole section (16) and a lower component (44) is provided in the lower end of the lower section (24/26). The upper (28) and lower components (44) each including a recess therein for securing one end of a length of elastic cord (58) to pull the upper pole section (16) into the intermediate pole section (20/22) and to pull the intermediate pole section (20/22) into the lower pole section (24/26). The upper component (28) has a resiliently flexible wire (60) protruding therefrom for supporting and tensioning a banner in the form of a flexible printed sheet (64). The support (12) and the wire (60) being within a protective sleeve (66).

2 Claims, 5 Drawing Sheets

DISPLAY STRUCTURE

This application is a continuation of international application PCT/ZA2004/000102 filed 26 Aug. 2004, published in English under PCT Article 21(2), which claims benefit from and is a Paris Convention filing of South African Application Serial No. 03/6707 filed 28 Aug. 2003, the specifications of which are hereby incorporated herein by reference.

BACKGROUND OF THE INVENTION

1. Field of the Invention

This invention relates to supports for banners.

2. Description of the Related Art

Flags and banners have become popular for advertising purposes. The present invention seeks to provide an improved support for a banner.

BRIEF SUMMARY OF THE INVENTION

According to one aspect of the present invention there is provided a support for a banner, the support comprising a pole having a lower section and an upper section which fit together spigot and socket fashion, and a length of elastic cord anchored to said sections to pull the spigot of one section into the socket of the other section, there being an upper component in the upper end of the upper section and a lower component in the lower end of the lower section, each component including means for securing one end of said cord.

In one form each component has an internal cavity, knots at the ends of said cord being in said cavities and there being passages from said cavities to the outside of each component.

Said upper component can comprise a cylindrical body having said cavity therein, a dome-shaped head at one end of said body and a stop surface between said head and said body for contacting the upper end of said upper section to prevent said head being pulled into the upper section.

Said head and part of the length of said body can have a passageway therein which extends axially through said head and said part of said body, said passageway having one end portion of a flexible wire therein which serves to tension a banner attached to the support.

The lower component can have an enlarged flange at one end which contacts the end of said lower section and prevents the lower component from fully entering the lower section.

In the preferred form, the support comprises an intermediate section between said lower section and said upper section, said sections fitting together spigot and socket fashion and said cord passing through said intermediate section. Each section can comprise inner and outer tubes.

In combination, a support as defined above and a banner in the form of a sheet with a sleeve along one edge, said support being in said sleeve.

BRIEF DESCRIPTION OF THE DRAWINGS

For a better understanding of the present invention, and to show how the same may be carried into effect, reference will now be made, by way of example, to the accompanying drawings in which:—

DETAILED DESCRIPTION

Figure 1:
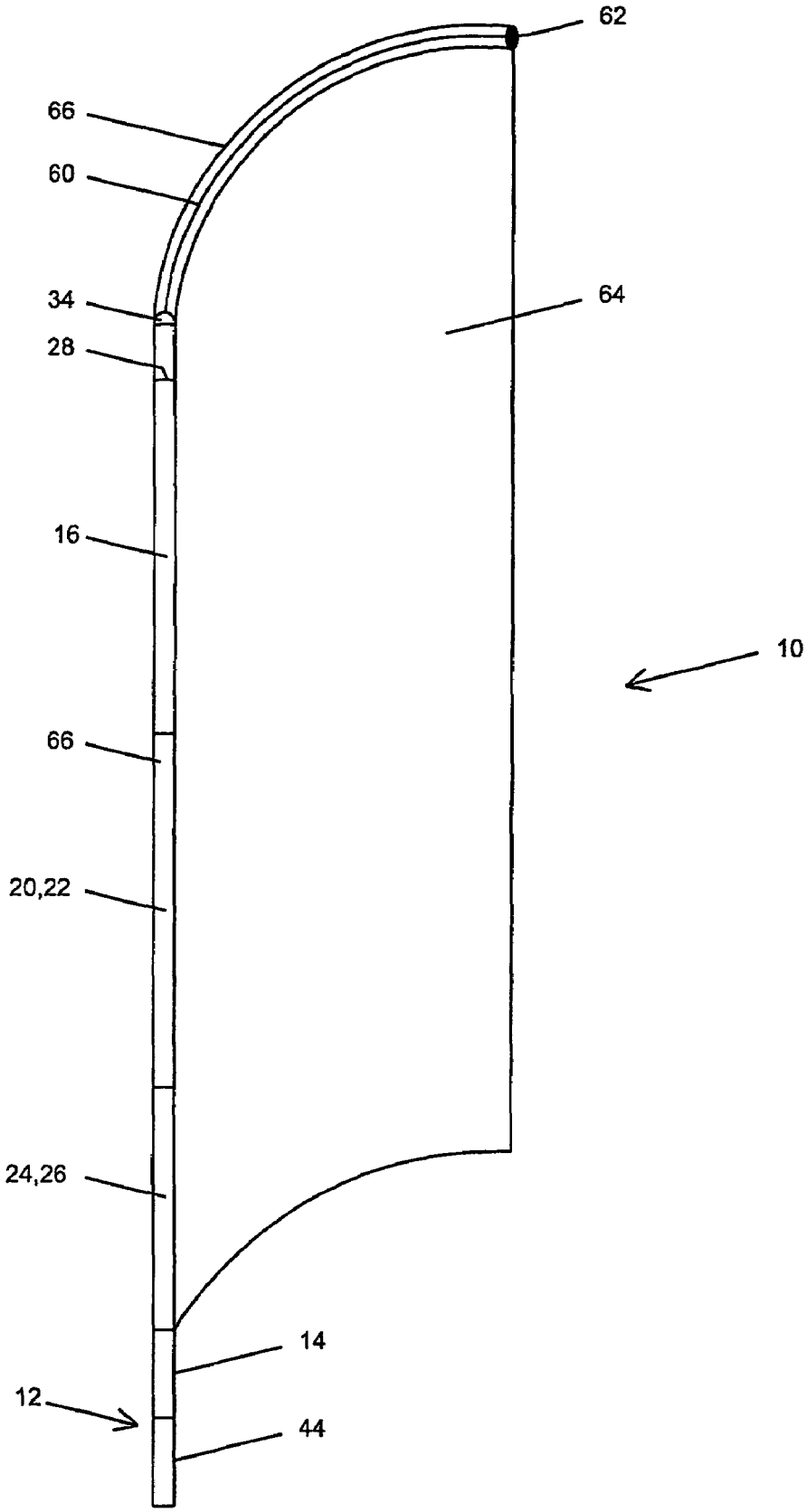
FIG. 1 is a side elevation of a display device including a support and a banner in accordance with the present invention.

The display device 10 shown in FIG. 1 comprises a support 12 including a pole 14 and a flexible wire. The wire will be described in more detail hereinafter.

Figure 2A:
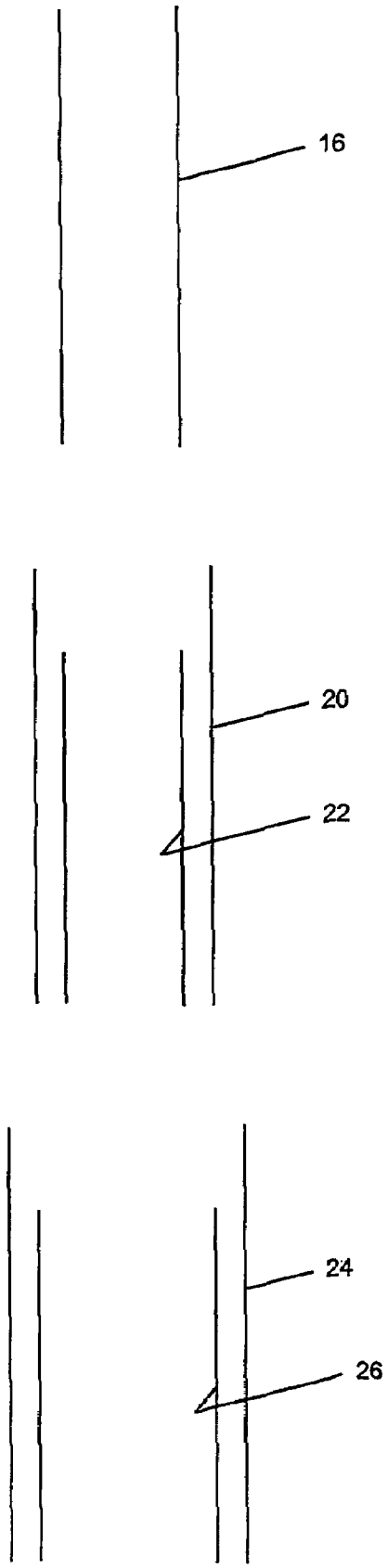
FIG. 2*a* is a diagrammatic representation of three pole sections, prior to assembly, which form a pole comprising part of the support.
Figure 2B:
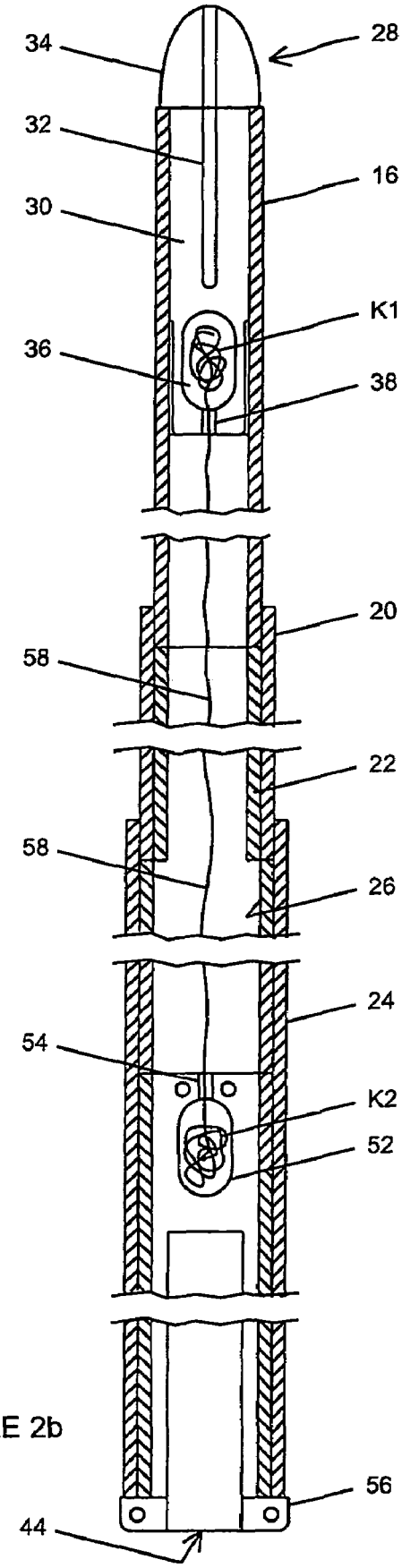
FIG. 2*b* is a section, to a larger scale, and showing the support in section.

The pole 14 is illustrated in unassembled form in FIG. 2*a* and in assembled form in FIG. 2*b*. The pole 14 comprises an outer upper tube 16, an outer intermediate tube 20, an inner intermediate tube 22 within the tube 20, an outer lower tube 24 and an inner lower tube 26 within the tube 24. The outer tubes 20 and 24 are constituted by lengths of anodized high tensile aluminium whilst the inner tubes 22 and 26 are of an un-anodized high tensile aluminium. Thus, when assembled the pole 14 consists of three pole sections 16, 20/22, and 24/26 (as illustrated in FIG. 2*b*).

The tube 16 is of the same diameter as the tube 22 and can slide into the upper end of the tube 20. Likewise, the tube 20 is of the same diameter as the tube 26 and can slide into the upper end of the tube 24.

Figure 3:
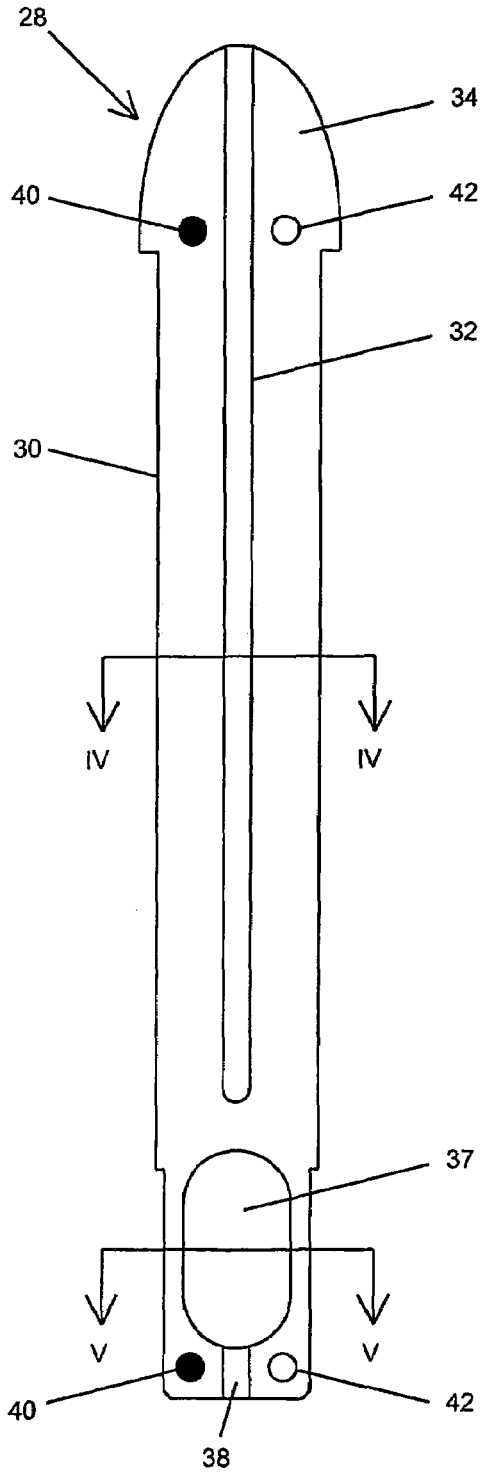
FIG. 3 is an elevation of one half of a top component of the support.
Figure 4:
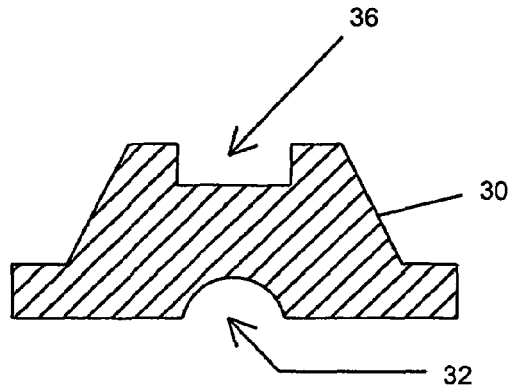
FIGS. 4 and 5 are sections, to a larger scale, on the lines IV-IV and V-V of the top component of FIG. 3.
Figure 5:
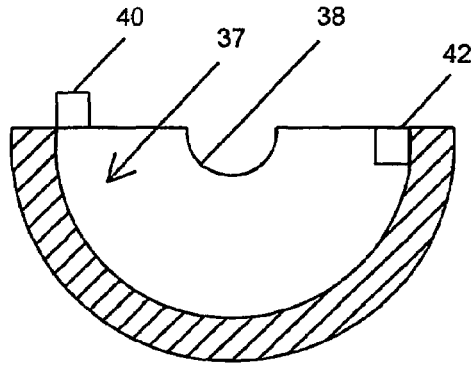

A top component 28 of the supporting structure 12 comprises two mouldings 30 (see FIGS. 3 to 5) of synthetic plastics material. Each moulding 30 is of generally semi-cylindrical form and has a groove 32 extending from one end thereof to a position close to the other end thereof. Externally the moulding 30 has longitudinally extending grooves 36 which extend over a substantial portion of the length of the component 28.

The moulding 30 also has a head 34 which is generally in the form of one half of a dome.

At the end of the component 28 remote from the head 34 there is a recess 37. A groove 38 leads from the recess 37 and opens through the end surface of the component 28.

The mouldings 30 have pins 40 and recesses 42 so that two mouldings 30 can be snap-fitted together to form the component 28. Once the mouldings 30 are fitted together, the grooves 32 of each moulding 30 form a bore extending along the component 28, the co-operating recesses 37 form an internal cavity and the grooves 38 form a passage leading into said internal cavity.

Figure 6:
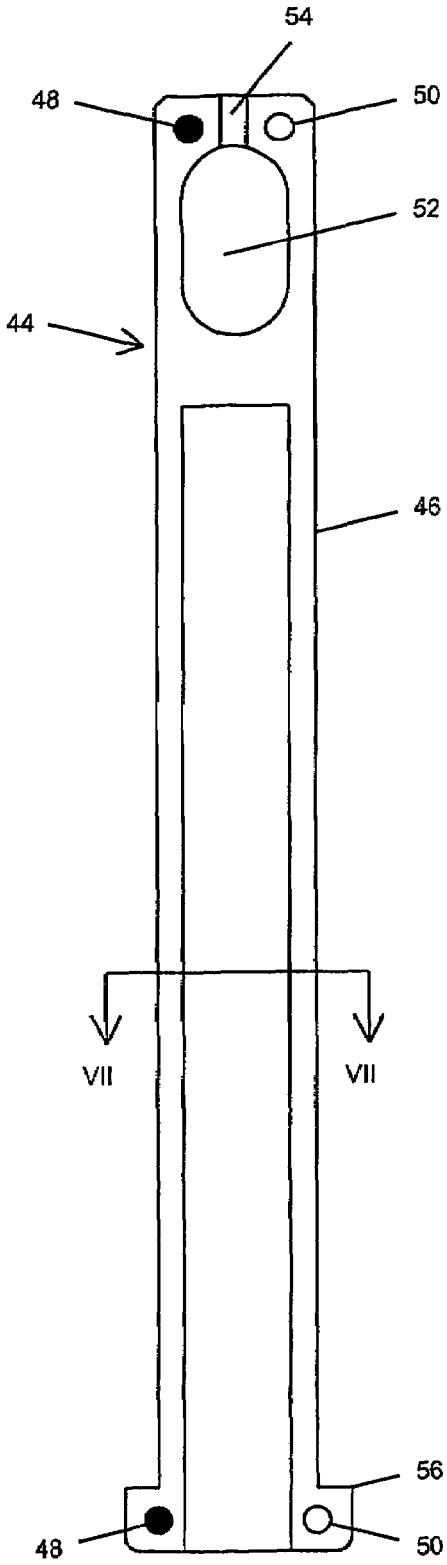
FIG. 6 is an elevation of one half of a lower component of the support.
Figure 7:
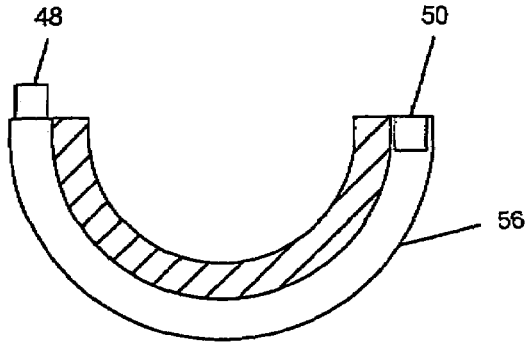
FIG. 7 is a section, to a larger scale, on the line VII-VII of the lower component of FIG. 6.

Turning now to FIGS. 6 and 7, a lower component 44 (see FIG. 2*b*) of the supporting structure 12 comprises two hollow mouldings 46 which can be snap-fitted together by means of pins 48 and sockets 50. The mouldings 46 are of hollow cylindrical form over a substantial portion of their length. Each moulding 46 has, at one end, a recess 52 and groove 54 of the same configuration as the recess 37 and groove 38 of the component 28.

A protruding flange 56 is provided at one end of each moulding 46.

When the mouldings 46 are fitted together to form the bottom component 44, an internal bore is formed which extends over a substantial portion of the length of the component 44. At one end there is an internal cavity formed by the recesses 52 and a passageway formed by the grooves 54.

During assembly of the display device 10, a length of elastic cord 58, nowadays sometimes referred to as "bungee cord", has a knot K1 (FIG. 2*b*) tied in one end. The knot K1 is pressed into one of the recesses 36 and the mouldings pressed together so that the knot K1 is trapped in the internal cavity. The cord 58 emerges from the internal cavity through the passageway constituted by the grooves 38.

The other end of the cord 58 is fed through the tube 16 and then the upper component 28 is pushed into the upper end of the tube 16 until the underside of the dome-shaped head 34 abuts the upper end of the tube 16.

The cord 58 is then fed through the tube sections 20/22 and 24/26 in succession so that it protrudes from the lower end of the tube 24.

Another knot K2 is tied at the protruding end of the cord 58 and this knot K2 is pressed into the recess 52 of one of the mouldings 46. The mouldings 46 are then snap fitted together so that the knot K2 is within the cavity formed by the recesses 52. The cord 58 emerges from the cavity by way of the passage constituted by the grooves 54.

The component 44 is then pushed into the lower end of the pole 24 until the flange 56 abuts the lower end of the pole 24.

The cord 58 pulls the three pole sections 16, 20/22 and 24/26 together, but permits the sections to be separated by pulling the pole 16 out of pole 20 and subsequently pulling the pole 20 out of pole 24 and allowing the pole 14 to be folded. The cord 58 is stretched as the poles sections are separated.

A resiliently flexible wire 60 has a ball 62 at one end (see FIG. 1) and its other end inserted in the passageway constituted by the grooves 32 of the component 28.

The display device 10 further comprises a banner in the form of a flexible printed sheet 64 having a sleeve 66 sewn along one edge. The supporting structure 12 is fed into the sleeve 66 with the ball 62 leading. The sleeve 66 has a straight section and a curved section. As the wire 60 enters the curved section it is bent to the configuration shown in FIG. 1. The bent wire 60 tensions the sheet 64.

The open ended bore of the component 44 serves to receive, from the lower end thereof, the upper part of a spike (not shown) that has been driven into the ground, the upper part of a rod which protrudes from a heavy mass such as a concrete block or a water base, or a rod protruding from a wall bracket. The component 44 is free to swivel on its support.

The structure 12 described makes it possible to avoid forcing pop-rivet or the like through the walls of the tubes.

What is claimed is:

1. A support for a banner, comprising:

a pole having a lower section and an upper section which fit together spigot and socket fashion;

a length of elastic cord anchored to said sections to pull the spigot of one section into the socket of the other section;

an upper component in the upper end of the upper section;

a lower component in the lower end of the lower section, each component configured to secure one end of said cord;

wherein each component has an internal cavity, knots at both ends of said cord being in said cavities and there being passages from said cavities to outside of each component; and, wherein that said upper component comprises a cylindrical body having said cavity wherein, a dome-shaped head at one end of said body and a stop surface between said head and said body for contacting said upper end of said upper section to prevent said head being pulled into said upper section.

2. A support for a banner comprising:

a pole having a lower section and an upper section which fit together spigot and socket fashion, a length of elastic cord anchored to said lower section and to said upper section and configured to pull the spigot of one section into the socket of the other section;

an upper component in the upper end of the upper section;

a lower component in the lower end of the lower section, each component being configured to secure one end of said cord;

an intermediate section between said lower section and said upper section, said sections fitting together spigot and socket fashion and said cord passing through said intermediate section; and, said upper, lower and intermediate sections comprising inner and outer tubes.

* * * * *